United States Patent [19]

Sosower

[11] Patent Number: 4,750,638

[45] Date of Patent: Jun. 14, 1988

[54] TRASH ORGANIZER

[76] Inventor: Leon Sosower, 49 Allwood Pl., Clifton, N.J. 07012

[21] Appl. No.: 139,585

[22] Filed: Dec. 30, 1987

[51] Int. Cl.[4] ..... B65D 90/04

[52] U.S. Cl. ..... 220/404; 220/1 T

[58] Field of Search ..... 220/404, 1 T, 4 E, 4 C, 220/4 D, 22, 23.4, 85 R

[56] References Cited

U.S. PATENT DOCUMENTS

| | | | |
|---|---|---|---|
| 2,736,454 | 2/1956 | McConnell | 220/404 X |
| 3,130,853 | 4/1964 | Colthurst et al. | 220/404 |
| 3,402,848 | 9/1968 | Busey | 220/1 T X |
| 3,720,346 | 3/1973 | Cypher | 220/1 T X |
| 3,977,450 | 8/1976 | Schampier | 220/404 X |
| 4,418,835 | 12/1983 | Watts | 220/404 |
| 4,535,911 | 8/1985 | Goulter | 220/404 |

*Primary Examiner*—Steven M. Pollard

[57] ABSTRACT

The disclosed trash can is divided into two compartments by two side-by-side trash can liners for separately accumulating two classes of waste. An extensible divider is placed across the top opening of the trash can; there are clips along each side of the divider and along the top opening of the trash can so that each trash can liner is readily secured in position and removed independent of the other.

3 Claims, 1 Drawing Sheet

TRASH ORGANIZER

This invention relates to apparatus for facilitating the accummulation of sorted trash.

As a matter of local policy in some communities and governmental requirement in other communities, trash should be sorted in two categories as it accumulates. Notably, bottles and cans should be sorted from the other waste. It has proved impractical for many householders to designate an entire trash can for each category of waste and, in such circumstances, it requires particular discipline and determination to sort accumulating waste. To assist the householder, a variety of aids have been proposed over many years for sorting waste as it accumulates, such as separate segmental cans fitting together in a single barrel. Factors of cost and inconvenience of proposed trash sorting and collecting devices have apparently deterred their widespread acceptance.

The present invention provides a means for converting a single trash can or barrel into compartmented storage for two categories of waste. Trash cans are widely used with plastic liners—commonly large plastic bags—supported by placing the liner in the trash can and folding the mouth or opening of the liner over the trash can's rim. Pursuant to the present invention, a divider is placed across the top of the trash can; two liners are placed in the trash can at opposite sides of the divider; and two separate sets of clips are provided, one set for each liner. The divider has two rows of clips, one at each of its sides. As a result, each of two liners can be placed in the trash can and secured in place independently, providing compartments for separately storing two categories of waste. Each liner can be removed as soon as it is filled without in any way disturbing the securement of the other liner. Thus, if one liner is used as a compartment for accumulating bottles and cans, it may be removed frequently or only occasionally, in time with trips of the householder to can and bottle collection depots. If the second liner is used for collecting garbage, it may be removed and replaced whenever it is filled, without disturbing the other liner supported in the trash can.

The divider disclosed in detail below is of a form that is practical and economical, to promote wide acceptance, and for that reason it is made adjustable lengthwise. It comprises a pair of elongated molded plastic parts, alike in proportions and dimensions. Both can come from a single mold. The parts are slidable along one another for adjusting the length of the divider. A common fastener holds a liner-supporting clip and the two elongated parts in a common assembly. The fastener extends through the liner-securing clip and through longitudinal slots in mutually overlying portions of the divider's elongated parts. The construction is not only highly effective for its purpose, but it is also extremely economical. It comprises two identical molded divider parts, liner securing clips secured to the assembled divider parts, and fasteners. Separate clips are provided for securing the liner to the rim of the trash can. The apparatus is equally effective with round and rectangular trash cans of a wide range of different sizes, both of plastic and of metal. The divider has end formations that restrain it against lengthwise movement, and those end formations lie against outer areas of the trash can at its rim, being slender so as to be received inside the rim of the trash can's cover.

An exemplary embodiment of the invention is shown in the accompanying drawings and described in detail below. In the drawings.

Figure 1:
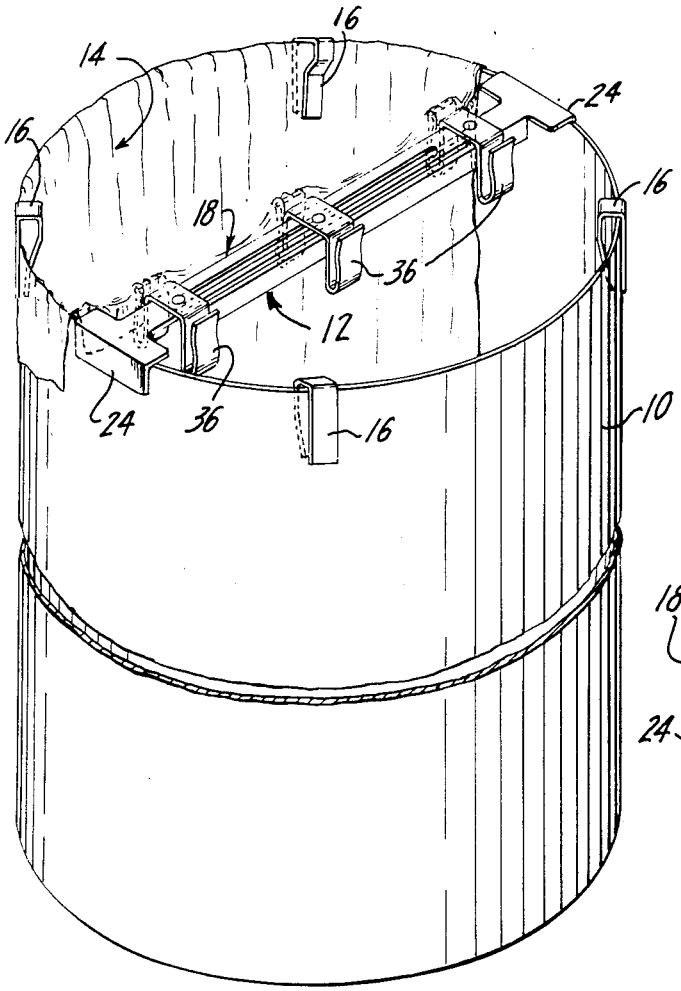
FIG. 1 is a perspective view of a trash can and one trash can liner, together with apparatus including a divider for supporting two liners to constitute two compartments.

Referring now to the drawings, trash can 10 in FIG. 1 is equipped with a divider 12 across its center, for supporting two trash can liners 14, only one of which is shown. The trash can liners are supported by divider 12 and by the rim of the trash can. Liner 14 is folded over the rim of the trash can and secured in place by resilient clips 16.

Divider 12 consists of two identical elongated parts 18. Each part 18 comprises an elongated horizontal panel 20 and a vertical wall 22 that form a right angle where they meet. Walls 22 stiffen divider 12. A slender vertical locating element 24 depending from an extremity of panel 20 extends transverse to depending wall 22. A slot 26 through panel 20 extends along most of the length of that panel. Part 18 is a one-piece molded plastic member.

Figure 3:
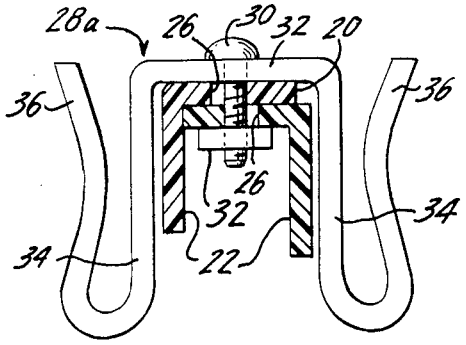
FIG. 3 is a cross-section of the divider of FIG. 2 at the plane 3—3, drawn to larger scale.
Figure 6:
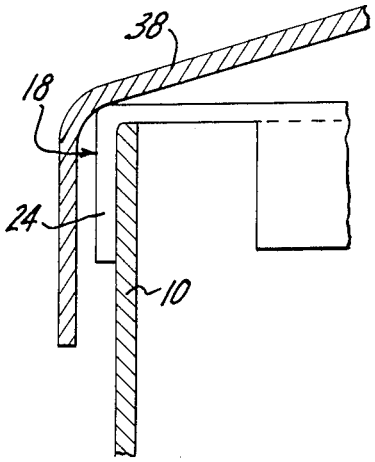
FIG. 6 is a fragmentary cross-section of the trash can and the divider of FIG. 1, with the trash can's cover in place.
Figure 2:
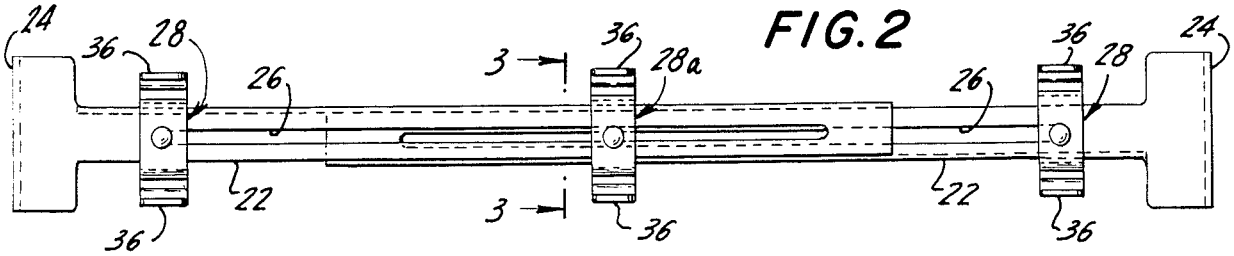
FIG. 2 is a top plan view of the divider of FIG. 1, drawn to larger scale.

Two parts 18 are assembled along each other with one horizontal panel 20 overlying the other (FIGS. 2 and 3). A securing device 28 is mounted at the end of slot 26 nearest element 24 of each part 18. A third securing element **28*a* is mounted between them. All three securing devices are identical but securing element 28*a* is mounted where panels 20 of the two parts 18** overlap each other.

In FIG. 3, a screw 30 and a retainer 31 serve as a fastening means that holds two elongated parts 18 in sliding contact with each other and unifies the two parts 18 and the securing element **28*a*. Screw 30 extends through securing element 28*a* and both slots 26 in parts 18, holding an edge of the lower panel 20 against a wall 22 and holding parts 18 in alignment. Slots 26 subdivide each panel 20 into long and more-or-less flexible portions. Securing element 28*a* includes a base portion 32 overlying assembled panels 20 and portions 34 that extend down from opposite ends of base portion 32, in the form of an inverted "U". Depending portions 34 closely straddle elements 18, preventing the portions of panels 20 (divided by slots 26) from spreading unduly. Upstanding clips 36 extend from the lower ends of portions 34. These clips, at opposite sides of divider 12, provide independent securement and support for each of the two liners in the trash can at the opposite sides of divider 12**.

In use, divider 12 is adjusted to a length appropriate to the diameter of trash can 12 which is generally cylindrical in the illustrative example. Divider 12 is equally useful for rectangular trash cans. Divider 12 is placed in the rim of trash can 10 and the end elements 24 are pushed toward each other until they lie against an external area of the trash can adjacent its rim. Elements 24 thus serve to locate divider 12 on the trash can. Securing device 28a is moved (if necessary) to position it at roughly equal distances from the other securing devices 28. Those securing devices are fastened to parts 18, respectively, by screws 30 and fasteners 32 but devices 28 may alternatively be molded as integral portions of parts 18.

Securing devices 28 and 28a provide two rows of clips 36, one row at each side of divider 12. Each row is available for securing a marginal portion of a liner 14 to the divider. Clips 16 distribute along the rim of the trash can secure other marginal portions of each liner 14 along its opening to the rim of the trash can. Each liner thus has its own set of securing clips 16 and 36. Each of two liners can be placed in trash can 10 independently and secured in place, and each of two liners can be removed without disturbing a previously installed trash can liner.

Figure 7:
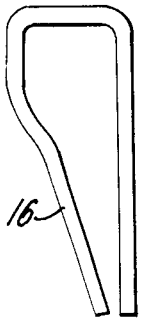
FIG. 7 is a side elevation of a clip, being one of several that complement the divider in holding the margins of trash can liners in place at the trash can's rim.
Figure 4:
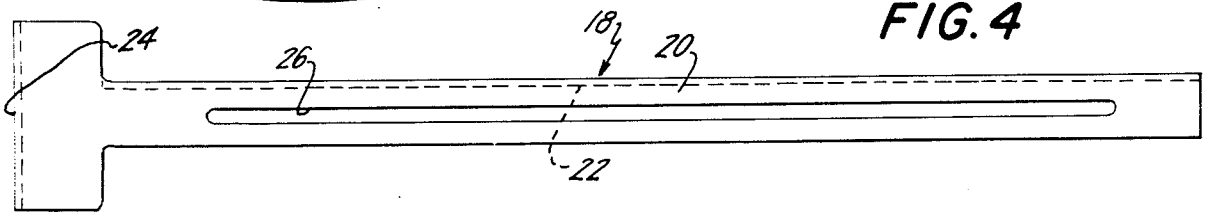
FIGS. 4 and 5 are a top plan view and a side elevation of an elongated part, being one of two identical parts of the divider of FIG. 2.
Figure 5:
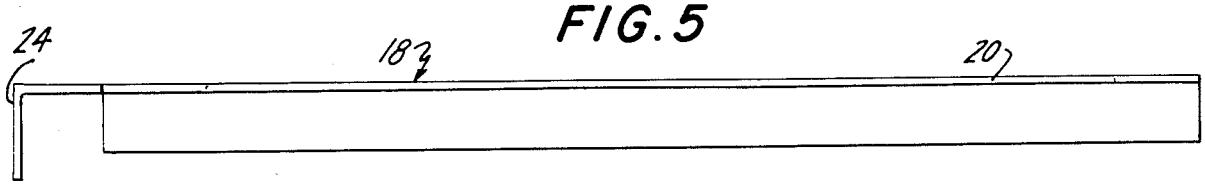

Together, two trash can liners 14 provide two trash sortation compartments in trash can 10. The cost of the divider, economically produced as described, is so low that its use is encouraged. Sortation of trash is promoted. The divider is easily installed, and it will serve various sizes and shapes of trash can, including round, square and rectangular forms. Elements 24 are slender and they are easily placed against outside areas of trash can 10 adjacent to its rim. In that position, all but the tightest-fitting covers 38 can be placed on the trash can (FIG. 7).

The illustrative apparatus described represents the presently preferred construction. But because it is amenable to variations, as will be apparent, the following claims should be construed in accordance with the spirit and scope of the invention.

What is claimed is:

1. Apparatus for supporting the open mouths of two trash can liners at the rim of a trash can so that the liners are positioned in the trash can side-by-side for providing two trash sortation compartments, said apparatus including an elongated divider adapted to extend across the trash can and including end portions to rest on said rim, said end portions comprising locating formations engaging respective outside marginal areas of the trash can adjacent its rim, said locating formations being slender for reception within the cover of the trash can when in place on the trash can, said divider comprising telescopic parts enabling the divider to extend across trash containers of various sizes, and securing devices distributed along said divider including two rows of clips at the opposite sides, respectively, of said divider, each of the rows of clips being effective for securing a marginal portion of each liner independently at the opening thereof to a respective side of the divider.

2. Apparatus for supporting the open mouths of two trash can liners at the rim of a trash can so that the liners are positioned in the trash can side-by-side for providing two trash sortation compartments, said apparatus including an elongated divider adapted to extend across the trash can and said divider comprising two elongated parts that are longitudinally adjustable relative to each other, said elongated parts being of molded plastic and being alike in dimensions and shape, said elongated parts, when assembled, comprising opposite-end locating formations engageable with the rim of the trash can, each of said elongated parts comprising an elongated horizontal panel and an elongated vertical wall having respective longitudinal margins unified with each other, one of said horizontal panels overlying the other when said elongated parts are assembled and the vertical walls of said parts being spaced apart and depending from said horizontal panels, respectively, one longitudinal edge of the horizontal panel of one of said elongated parts abutting and being guided by the depending vertical wall of the other of said elongated parts, and a row of securing devices distributed along said divider, the cross-section of each of said securing devices being in part in the shape of a "U" including a base portion overlying said horizontal panels and including side portions depending from said base portion, said side portions of at least one of said securing devices closely straddling said elongated parts for restraining them in alignment, said horizontal panels having aligned longitudinal slots, and fastening means for holding said elongated parts in longitudinally adjustable assembly to each other, said fastening means including a retainer under the horizontal panels and an element extending from said base portion of said one of said securing devices through said slots to said retainer, each of said securing devices having clips at opposite sides of the divider, the clips of the securing devices thus being distrubted in two rows at the opposite sides of the divider for securing a marginal portion of each liner adjacent its opening independently to said divider.

3. Trash collection apparatus including a trash can, a pair of trash can liners, and means for supporting said trash can liners in said trash can so as to form two side-by-side compartments, said supporting means including a lengthwise adjustable elongated divider having end portions cooperating with the rim of the trash can for supporting the divider and for retaining the divider in position, and said divider comprising lengthwise slotted parts one of which overlies the other, and a trash-can liner securing device overlying and closely straddling said slotted parts and a fastening device extending through said securing device and said slotted parts for holding the securing device and the slotted parts together so that said slotted parts are adjustable lengthwise in relation to each other and are retained in alignment with each other, said securing device having trash-can-liner securing elements on opposite sides of said divider, and clips distributed around the rim of the trash can acting with said trash-can-liner securing elements for securing each trash can liner in place independently and for releasing each trash can liner separately.

* * * * *